US005406365A

United States Patent [19]

Baba et al.

[11] Patent Number: 5,406,365

[45] Date of Patent: Apr. 11, 1995

[54] IMAGE FORMING APPARATUS HAVING CLEANING MECHANISM WITH PARTITION MEMBERS NOT ALIGNED WITH CONVEY ROLLERS

[75] Inventors: Mutsumi Baba; Shinya Noda, both of Yokohama, Japan

[73] Assignee: Canon Kabushiki Kaisha, Tokyo, Japan

[21] Appl. No.: 975,103

[22] Filed: Nov. 12, 1992

[30] Foreign Application Priority Data

May 7, 1992 [JP] Japan ..... 4-141125

[51] Int. Cl.[6] ..... G03G 21/00

[52] U.S. Cl. ..... 355/298; 355/309

[58] Field of Search ..... 355/308, 309, 296, 298, 355/299, 300, 301; 15/256.5, 256.51, 256.52, 256.53

[56] References Cited

U.S. PATENT DOCUMENTS

| | | | |
|---|---|---|---|
| 4,501,484 | 2/1985 | Shimura | 355/301 |
| 4,530,594 | 7/1985 | Adachi | 355/298 |
| 4,678,318 | 7/1987 | Bisaiji | 355/296 |
| 4,870,449 | 9/1989 | Brown | 355/297 |
| 5,107,305 | 4/1992 | Charland et al. | 355/298 |
| 5,111,251 | 5/1992 | Uno et al. | 355/297 |

FOREIGN PATENT DOCUMENTS

| | | | |
|---|---|---|---|
| 0204673 | 9/1986 | Japan | 355/298 |
| 63-149669 | 6/1988 | Japan . | |
| 0210382 | 8/1990 | Japan | 355/298 |
| 0213868 | 8/1990 | Japan | 355/298 |
| 0059693 | 3/1991 | Japan | 355/298 |
| 0204988 | 7/1992 | Japan | 355/298 |
| 2102390 | 2/1983 | United Kingdom . | |

*Primary Examiner*—Robert B. Beatty

*Attorney, Agent, or Firm*—Fitzpatrick, Cella, Harper & Scinto

[57] ABSTRACT

A cleaning mechanism includes a cleaning device for removing residual matter from an image bearing member, a receiving device for receiving the removed matter removed from the image bearing member by the cleaning device, and a partition member for partitioning the receiving device. The end of the partition member near the image bearing member is not aligned with a contacting area between the recording medium and a convey device for conveying the recording medium, in a recording medium convey direction.

36 Claims, 14 Drawing Sheets

IMAGE FORMING APPARATUS HAVING CLEANING MECHANISM WITH PARTITION MEMBERS NOT ALIGNED WITH CONVEY ROLLERS

BACKGROUND OF THE INVENTION

1. Field of the Invention

The present invention relates to a cleaning mechanism, an image forming apparatus and an image forming system. Such an image forming apparatus may be embodied, for example, as an electrophotographic copying machine, a laser beam printer, an LED printer, a word processor, a facsimile or the like.

2. Related Background Art

In order to explain the background of the present invention, an image forming arrangement of a typical copying machine is shown in FIG. 13. In this arrangement, recording members (recording media) 52 are stacked on a stacking plate 51 pivotally mounted on a pin 50, which stacking plate is biased toward a supply roller 54 so that the stacked recording members 52 are abutted against the supply roller. When the supply roller 54 is rotated, only an uppermost recording member 52 is separated from the other recording members by a friction pad 55 biased toward the supply roller 54 and is fed to a pair of regist rollers 56*a*, 56*b* which in turn feed the recording member to a process cartridge 57 constituting an image forming station. The process cartridge 57 serves to uniformly charge a surface of a photosensitive drum (image bearing member) 57*a* by a charger 57*b*, form a latent image on the photosensitive drum by selectively exposing the latter and develop the latent image with toner by a developing device 57*c*. The toner image is transferred onto the recording member 52 to form an image on the latter. Therefore, the recording member 52 is sent to a fixing device (not shown) where the toner image is fixed to the recording member. Then, the recording member is ejected out of the copying machine.

After the transferring operation, the residual toner remaining on the photosensitive drum 57*a* is removed by a cleaning device 57*d*. As shown in FIG. 14, the cleaning device 57*d* comprises a cleaning blade 57*d1* for scraping the residual toner on the photosensitive drum 57*a*, and a dip sheet 57*d2* for receiving the scraped toner and for sending it to a cleaning container 57*d3*. Incidentally, the dip sheet 57*d2* comprises a thin elastic sheet and is lightly contacted with the peripheral surface of the photosensitive drum 57*a* so as to permit the passage of the residual toner on the photosensitive drum 57*a* but direct the toner scraped by the blade 57*d1* to the container 57*d3*.

Further, the cleaning device 57*d* has partition walls 57*d4* which extend to a direction perpendicular to a rotation axis 57*a1* of the photosensitive drum 57*a* as shown by the alternate long and short dash line in FIG. 15 and serve to divide the cleaning container 57*d3* into a plurality of chambers so that the waste toner collected from leaking from the container 57*d3* due to the offset of the waste toner. Incidentally, regarding this technique, the effective invention has been proposed by the inventors as disclosed in U.S. Pat. No. 4,530,594.

As mentioned above, in the cleaning container 57*d* the interior of which is divided into a plurality of chambers by the partition walls 57*d4*, each partition wall has a thickness T and, as shown in FIG. 14, free ends of the partition walls are spaced apart from the photosensitive drum 57*a* by a small gap L (about 1 mm–3 mm). Consequently, small spaces V each having a volume of $T \times L$ are formed at an end of the cleaning container where the partition walls 57*d4* confront to the photosensitive drum 57*a*.

Further, as shown in FIG. 16, the small spaces V (hatched portions shown in FIG. 16) are aligned with or confronted to an area where the supply roller 54 and the friction pad 55 are contacted with the recording member 52 and an area where the paired regist rollers 56*a*, 56*b* are contacted with the recording member in a recording member convey direction. In such a case, paper powder generated when a recording paper sheet as the recording member 52 passes between the supply roller 54 and the friction pad 55 and between the paired regist rollers 56*a*, 56*b* is sent to the image forming station together with the recording member 52. Then, the paper powder goes along the photosensitive drum 57*a* and is coagulated together with the residual toner, thereby sometimes filling the small spaces V. As a result, it is feared that the residual toner cannot be collected effectively, with the result that the toner may spill from the cleaning container 57*d3*.

Further, when the recording member 52 is conveyed by the supply roller 54 and/or the paired regist rollers 56*a*, 56*b*, as shown in FIG. 17, the paired regist rollers 56*a*, 56*b* are flexed or deflected in accordance with the thickness of the recording member 52, with the result that the contacting pressure between the recording member 52 and the regist rollers at both ends 52*a*, 52*b* of the recording member sometimes becomes greater than that at a central portion of the recording member. As a result, the both ends 52*a*, 52*b* of the recording member 52 become particularly nappy and the paper powder is greatly generated at the both ends of the recording member. Further, other than by the contacting pressure of the rollers, the both ends 52*a*, 52*b* of the recording member 52 are apt to become nappy due to the cutting of the recording member, and thus, when the both ends of the recording member are contacted with the convey guide and the like, the both ends of the recording member become more nappy and a larger amount of paper powder is generated.

By the way, recently, in order to use resources on the earth effectively, corrugated cardboards, newspapers and/or waste copied paper sheets have been re-cycled to obtain regenerated paper sheets for use as recording members 52. The regenerated paper sheets generally have paper fibers shorter than those in the recording members which are not made from the regenerated paper sheets, and thus, are apt to become happy and generate paper powder. The generated paper powder is apt to be coagulated, and particularly, is apt to form the condensation. As a result, it is still feared that the small spaces V of the cleaning container 57*d3* will be filled with coagulated.

Incidentally, some cleaning devices have a mechanism for forcibly feeding the waste toner collected in the cleaning container 57*d3* into the interior of the container. In such cleaning devices, since the collected waste toner is forcibly fed into the interior of the cleaning container, the possibility that the small spaces V are filled with the toner is reduced. However, for example, as shown in FIG. 18, since the toner feeding mechanism forcibly feeds the toner by rotating a feed vane 58*a* in a direction shown by the arrow, it is necessary to provide the feed vane 58*a*, a gear 58*b* attached to a rotary shaft of the feed vane 58*a* to rotate the latter, and an idler gear 58*c* for transmitting a driving force from a photosensitive drum gear 59 to the gear 58*b*.

Further, nowadays, process cartridges each incorporating therein a photosensitive drum 57*a*, cleaning device 57*d* and the like as a unit which can be removably mounted within an image forming apparatus thereby to facilitate the supply of toner and the maintenance have been used. It has been desired to make such process cartridges small-sized and to reduce the cost of the process cartridges. Accordingly, if the above-mentioned toner feeding mechanism is provided in the cleaning device 57*d*, the number of parts will be increased to result in an increased cost and the toner feeding mechanism will require an additional space, thus preventing the compactness of the process cartridge.

SUMMARY OF THE INVENTION

An object of the present invention is to provide a cleaning mechanism, an image forming apparatus and an image forming system which can remarkably improve the cleaning ability.

Another object of the present invention is to provide a cleaning mechanism, an image forming apparatus and an image forming system which can prevent developer from spilling.

A further object of the present invention is to provide a cleaning mechanism, an image forming apparatus and an image forming system wherein an image can be formed on a recording member comprised of a regenerated paper sheet, thereby greatly contributing to the protection of resources on the earth.

A still further object of the present invention is to provide a cleaning mechanism, an image forming apparatus and an image forming system which can form an image with high quality.

A further object of the present invention is to provide a cleaning mechanism, an image forming apparatus and an image forming system wherein, when residual developer remaining on an image bearing member is collected into a container of a cleaning means, small spaces formed at ends of partition members for dividing the container into a plurality of chambers, which ends are opposed to the image bearing member, are not easily filled with the developer, thereby preventing the developer from spilling.

The other object of the present invention is to provide a cleaning mechanism, an image forming apparatus and an image forming system wherein, since ends of partition members of a cleaning means opposed to an image bearing member are not aligned with a contacting area between a convey means and a recording member, even when paper powder is generated due to the friction between the convey means and the recording member, small spaces formed at the aforementioned ends of the partition members are not filled with developer coagulated together with the paper powder, thereby preventing the developer from spilling, and thus, performing the image formation with high quality.

DETAILED DESCRIPTION OF THE PREFERRED EMBODIMENTS

Now, a process cartridge and an image forming apparatus using such a process cartridge, according to a preferred embodiment of the present invention will be explained with reference to the accompanying drawings.

Incidentally, the present invention is not limited to the image forming apparatus using the process cartridge, but may be applied to any image forming apparatuses and systems using no process cartridge, and to cleaning mechanisms used with such apparatuses and systems.

First of all, a first embodiment of the present invention will be explained.

General Explanation of Image Forming Apparatus

Figure 2:
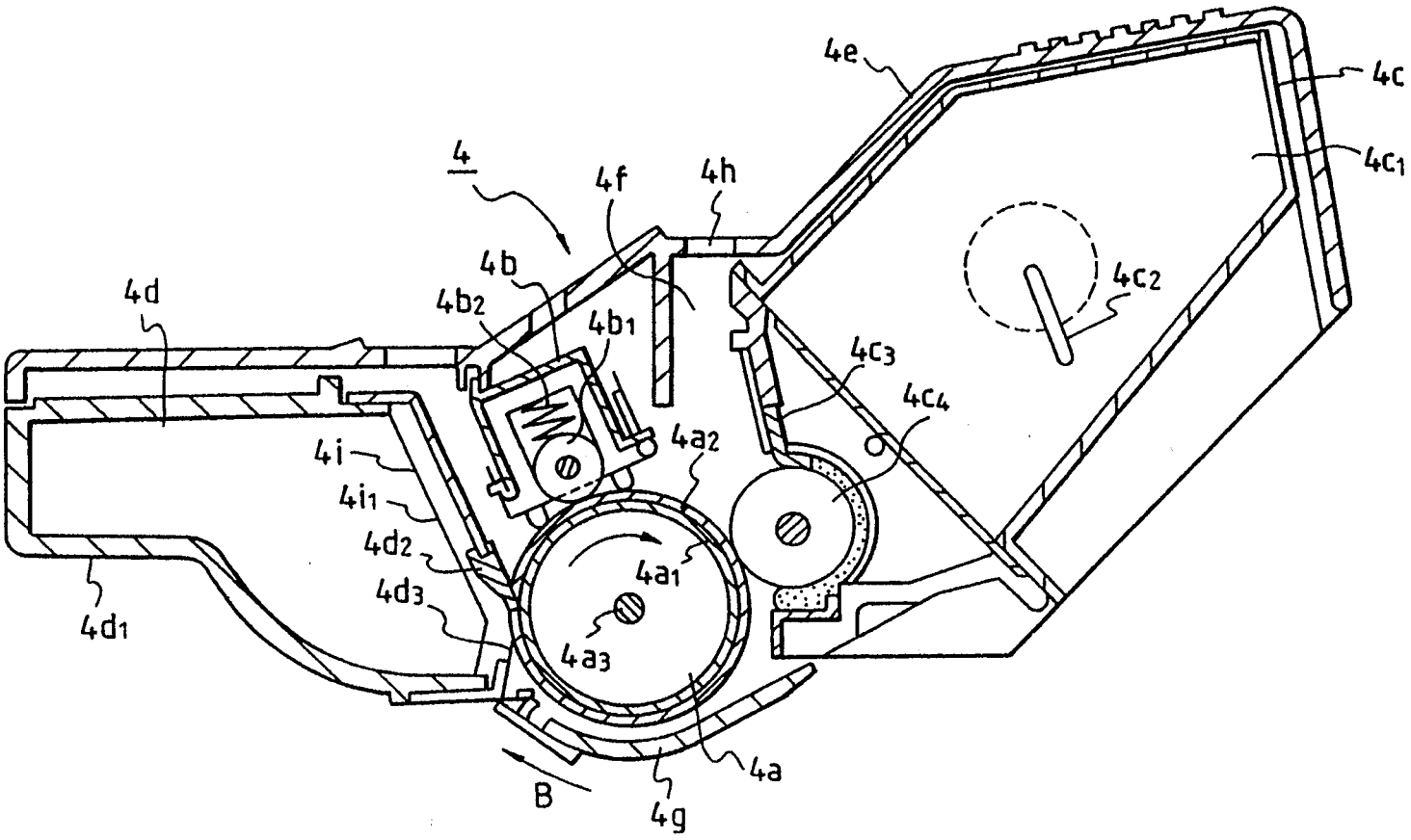
FIG. 2 is a sectional view of a process cartridge.
Figure 3:
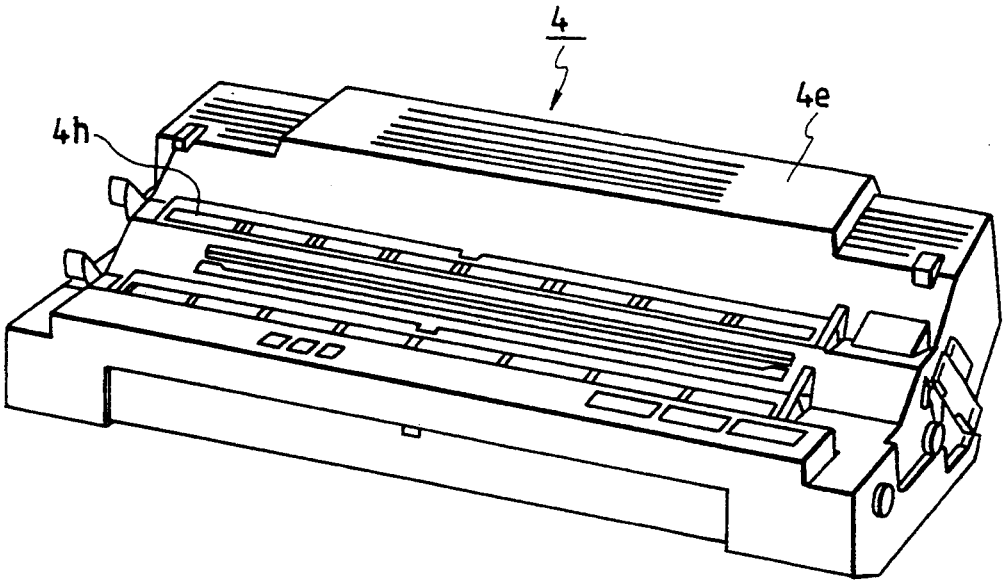
FIG. 3 is a perspective view of the process cartridge.

Firstly, the whole construction of an image forming system will be described. Incidentally, FIG. 1 is an elevational sectional view of a laser beam printer as an example of the image forming apparatus, FIG. 2 is a sectional view of a process cartridge, and FIG. 3 is a perspective view of the process cartridge.

Incidentally, it should be noted that the image forming apparatus of the present invention is not limited to the laser beam printer, but may be embodied as, for example, an electrophotographic copying machine, an LED printer, a word processor, a facsimile or the like.

Figure 1:
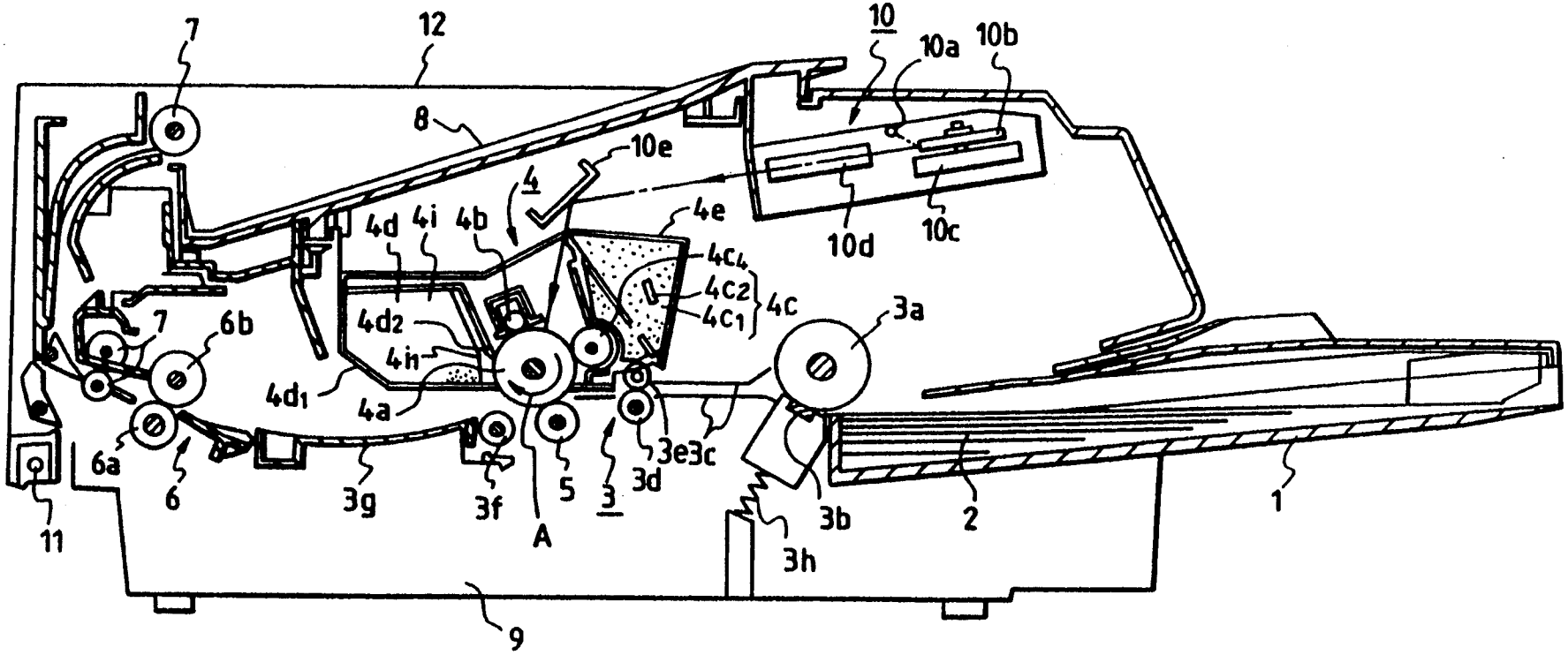
FIG. 1 is an elevational sectional view of an image forming apparatus according to a preferred embodiment of the present invention.

As shown in FIG. 1, the laser beam printer is designed so that a recording member 2 in a supply cassette 1 is supplied and fed by a convey means 3. An image is formed on an image bearing member at an image forming station where a process cartridge 4 is loaded, and the image is transferred onto the recording member 2 by a transfer means 5. Then, the recording member 2 is sent to a fixing station 6 wherein the image is permanently fixed to the recording member 2. Thereafter, the recording member is ejected in an ejection station 8 disposed at a top of the printer by means of ejector rollers 7. Incidentally, the process cartridge 4 is interchangeable and is removably mounted within a body 9 of the printer.

The exposure to the image forming station is sent from a scanner portion 10. That is to say, when an image signal is sent from a host device (not shown) to a laser diode 10*a*, the latter emits image light corresponding to the image signal to a polygonal mirror 10*b*. The polygonal mirror 10*b* is rotated by a scanner motor 10*c* at a high speed, and the image light reflected by the polygonal mirror 10*b* passes through a focusing lens 10*d* and is then reflected by a reflection mirror 10*e* to illuminate or light an image bearing member 4*a* through an exposure opening 4*h* of the process cartridge 4, thereby selectively exposing the image bearing member.

Next, various elements of the image forming apparatus and the process cartridge mountable with the image forming apparatus will be fully described.

Convey Means

A convey means 3 serves to convey the recording member 2 to the image forming station and to convey the recording sheet on which the image was formed to the fixing station 6. As shown in FIG. 1, the supply cassette 1 in which a plurality of recording members 2 are stacked is loaded in the body 9 of the printer. A pressure plate (not shown) disposed within the supply cassette 1 serves to urge an uppermost recording member in the stack against a supply roller 3*a*. A friction pad 3*b* is also urged against the supply roller 3*a* by a spring 3*h*. During the image forming operation, the supply roller 3*a* is rotated, and the supply roller cooperates with the friction pad 3*b* to separate the recording members 2 in the cassette 1 one by one from an uppermost recording member and to supply the separated recording member. The recording member 2 supplied from the supply cassette 1 is guided along guide plates 3*c* to a pair of regist rollers 3*d*, 3*e* by the rotation of the supply roller 3*a*. The regist rollers sent the recording member 2 to the image forming station in registration with the image formation timing. After the transferring operation, the recording member 2 is sent to the fixing station 6 by a convey roller 3*f* and a guide plate 3*g*.

At the image forming station, an image is formed on the recording member 2 conveyed by the convey means. Now, the construction of the process cartridge 4 will be explained.

Process Cartridge

The process cartridge is constituted by integrally incorporating the image bearing member, and at least a cleaning means for removing the residual developer remaining on the image bearing member as a cartridge. According to this embodiment, as shown in FIGS. 1 and 2, the process cartridge 4 is constituted by arranging a charger means 4*b*, a developing means 4*c* containing toner (developer) and a cleaning means 4*d* around an electrophotographic photosensitive drum (image bearing member) 4*a* and by enclosing these elements by a housing 4*e* as shown in FIG. 3 to form a cartridge or unit which can be removably mounted within the body 9 of the printer. Next, various parts of the process cartridge will be individually described.

Photosensitive Drum

The photosensitive drum 4*a* according to the illustrated embodiment comprises a cylindrical aluminum core 4*a1* and an organic photoconductive layer 4*a2* coated on an outer peripheral surface of the core, and is rotatably mounted on the housing via a drum shaft 4*a3*. The photosensitive drum 4*a* is rotated in a direction shown by the arrow A in FIG. 1 by transmitting a driving force from a drive motor (not shown) to a gear secured to the drum shaft 4*a3* in response to the image forming operation.

Charger Means

The charger means 4*b* is of a so-called contact charging type disclosed in the Japanese Patent Application Laid-Open No. 63-149669. More particularly, a conductive roller 4*b1* is abutted against the photosensitive drum 4*a* by a spring 4*b2*, and a surface of the photosensitive drum 4*a* is uniformly charged by applying a voltage to the conductive roller 4*b1*.

Incidentally, within the process cartridge, there is provided an exposure station 4*f* where a latent image is formed on the photosensitive drum 4*a* by illuminating the image light from the scanner portion 10, via the exposure opening 4*h*, on the photosensitive drum charged by the charger means 4*b*.

Developing Means

The developing means 4*c* serves to visualize the latent image by developing it with toner. As shown in FIG. 2, the developing means 4*c* comprises a container 4*c1* containing the toner therein, and a toner feed mechanism 4*c2* for feeding the toner toward the interior of the container 4*c1* by its own rotation. Further, at an end portion of the interior of the container to which the toner is fed by the toner feed mechanism 4*c2*, there are arranged a blade 4*c3* and a developing sleeve (developer bearing member) 4*c4*.

In the image formation, the developing means 4*c* is driven to form a toner image on the photosensitive drum 4*a*. More particularly, the toner in the container 4*c1* is fed to the interior of the container by the toner feed mechanism 4*c2*, the toner is coated on the rotating sleeve 4*c4* by the blade 4*c3* to form a thin toner layer on the sleeve, and the charge is applied to the toner. By applying the developing bias between the sleeve 4*c4* and the photosensitive drum 4*a* on which the latent image was formed, the toner image corresponding to the latent image is formed on the photosensitive drum 4*a*.

Incidentally, the developing means 4*c* is positioned by a positioning mechanism (not shown) so that the sleeve 4c4 is opposed to the photosensitive drum with a small gap (about 250 μm) therebetween. The sleeve is connected to a high voltage source for each color provided in the body 9 of the printer and is supplied with a voltage from the voltage source in the developing operation.

Protection Cover

In order to transfer the toner image visualized on the photosensitive drum 4a by the developing means 4c positioned with respect to the photosensitive drum 4a onto the recording member 2, during the image formation, the photosensitive drum 4a is exposed to confront to the transfer roller 5. However, since the process cartridge 4 can be dismounted from the body 9 of the printer, when the process cartridge 4 is dismounted from the body 9 of the printer, when the process cartridge 4 is dismounted from the body 9 of the printer, if the photosensitive drum 4a is still exposed, dirt or the like will adhere to the photosensitive drum and/or the photosensitive drum will be subjected to ambient light, thereby deteriorating the photosensitive drum. To avoid this, in the illustrated embodiment, as shown in FIG. 2, an opening/closing protection cover 4g is provided on the housing 4e.

The protection cover can be opened in a direction shown by the arrow B in FIG. 2 and is biased by a spring (not shown) toward a closed position. In a condition that the process cartridge 4 is dismounted from the body 9 of the printer, as shown in FIG. 2, the protection cover is closed to protect the photosensitive drum 4a from the ambient light. When the process cartridge 4 is mounted within the body 9 of the printer, the protection cover 4g is opened toward the direction B by a drive mechanism (not shown) to expose the photosensitive drum 4a in a confronting relation to the transfer roller 5.

Further, in association with the exposure station 4f, there is provided a protection cover for opening and closing the exposure opening 4h in response to the insertion of the process cartridge 4.

Cleaning Means

The cleaning means serves to clean or remove the toner remaining on the photosensitive drum 4a after the toner image visualized on the photosensitive drum 4a by the developing means 4c was transferred to the recording member 2. In the illustrated embodiment, as shown in FIG. 2, the cleaning means 4d includes a toner container 4d1 for receiving waste toner, an elastic blade 4d2, and a dip sheet 4d3. The residual toner remaining on the photosensitive drum 4a is scraped by the blade 4d2 while the drum is being rotated, and the removed toner is directed into the waste toner container 4d1 by the dip sheet 4d3.

Figure 4:
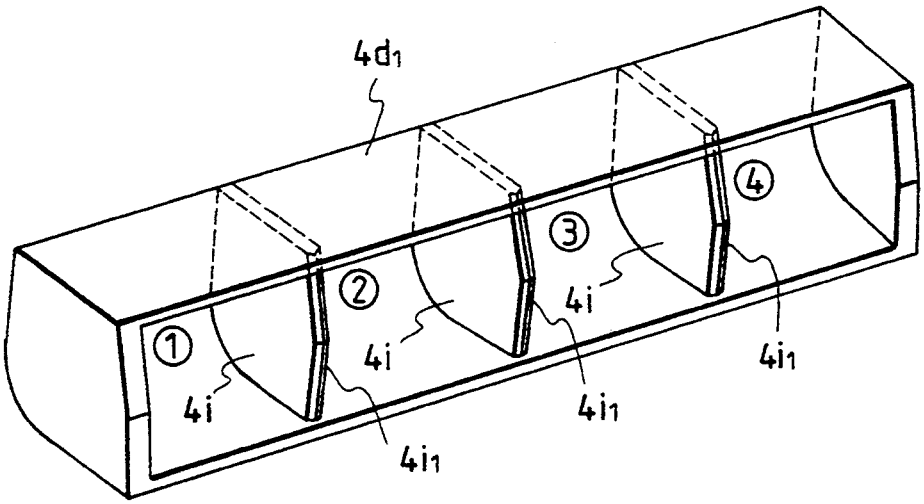
FIG. 4 is a perspective view of a cleaning container.

Further, as shown in FIG. 4, the waste toner container 4d1 is divided into a plurality of chambers ①-④ by partition members 4i arranged along a direction transverse to the drum shaft 4a3 (substantially perpendicular to the drum shaft 4a3 in the illustrated embodiment), thus preventing the offset of the collected toner in the container 4d1 thereby to avoid the overflow of the toner from the container. Each partition member 4i is constituted by a plate member having a thickness t, and an end of each plate member near the photosensitive drum 4a has an arcuate V-shaped configuration to reduce the thickness and converge toward the photosensitive drum. By forming the ends of the partition members 4i as the V-shaped configuration, the scraped toner can smoothly be collected into the container 4d1 as will be described later.

Loading Structure for Loading Process Cartridge on Printer

Next, a structure for mounting and dismounting the process cartridge with respect to the body 9 of the printer will be explained.

An upper opening/closing cover 12 is pivotally mounted on the body 9 of the printer via a shaft 11 and can be locked or unlocked with respect to the printer body by a hook (not shown).

Figure 5A:
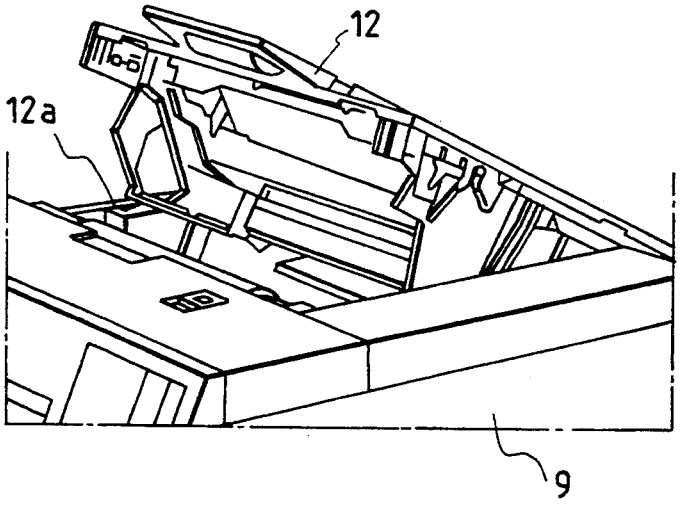
FIGS. 5A and 5B are partial perspective views of the apparatus for explaining the mounting of the process cartridge.
Figure 5B:
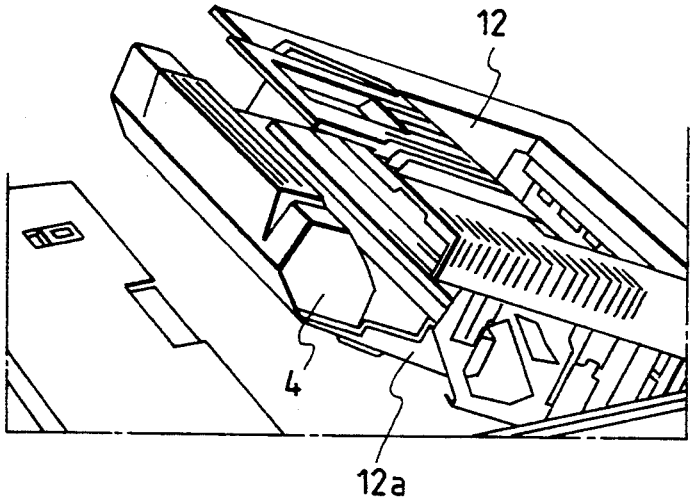

The upper opening/closing cover 12 has a laid U-shaped cross-section, and, as shown in FIGS. 5A and 5B, guide rails 12a for supporting both ends of the process cartridge 4 are formed on both side walls of the cover to oppose to each other. The guide rails 12a serves to guide a lower portion of the process cartridge 4 and are designed so that, when the opening/closing cover 12 is closed, they are inclined forwardly. Thus, when the process cartridge 4 is desired to be loaded, as shown in FIG. 5B, the opening/closing cover 12 is opened, and then, the process cartridge 4 is inserted and loaded while riding the lower portion of the cartridge on the guide rails 12a. In this condition, when the opening/closing cover 12 is closed, the aforementioned protection cover 4g is automatically opened, and a gear of the exposed photosensitive drum 4a is meshed with a drive gear (not shown) in the body 9 of the printer.

On the other hand, when the process cartridge is desired to be unloaded, contrary to the above, as the opening/closing cover 12 is opened, the protection cover 4g is automatically closed, and then, the process cartridge 4 can be withdrawn along the guide rails 12a.

Transfer Means

The toner image formed on the photosensitive drum 4a at the image forming station including the process cartridge 4 is transferred onto the recording member 2 by the transfer means 5. In the illustrated embodiment, as shown in FIG. 1, the transfer means is constituted by the transfer roller 5. More particularly, the recording member 2 is urged against the photosensitive drum 4a of the loaded process cartridge 4 by the transfer roller 5, and the toner on the photosensitive drum 4a is transferred onto the recording member 2 by applying a voltage having the polarity opposite to that of the toner.

Fixing Station

The fixing station 6 serves to fix the image formed on the recording member 2 by the process cartridge 4. As shown in FIG. 1, the fixing station includes a rotating drive roller 6a and a fixing roller 6b urged against the drive roller and adapted to apply heat and pressure to the recording member 2. More particularly, the recording member 2 is fed by the drive roller 6a and is subjected to the heat and pressure from the fixing roller 6b while it is being passed through the fixing station 6. In this way, the toner image is fixed to the recording member 2.

Relation between Partition Members of Cleaning Means and Convey Means

Now, a positional relation between the partition members 4i for dividing the container 4d1 of the cleaning means 4d into a plurality of chambers and the convey means 3 will be explained.

Figure 6:
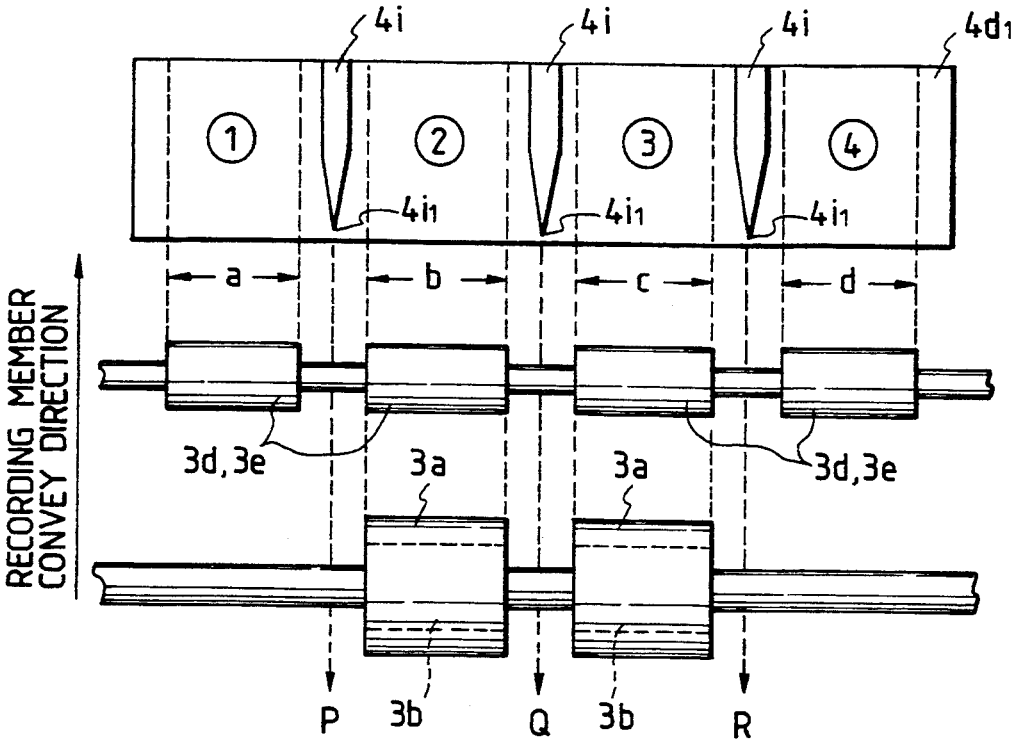
FIG. 6 is a plan view showing a positional relation between partition members of a cleaning container having V-shaped ends, and supply rollers and regist rollers.

As shown in FIG. 6 which is a plan view, the supply roller 3*a* is divided into two supply roller portions in a widthwise direction of the recording member 2, and the regist rollers 3*d*, 3*e* are also divided into four roller portions in an axial direction. That is to say, the supply rollers 3*a* are spaced apart from each other side by side, and the paired regist rollers 3*d*, 3*e* are also spaced apart from each other side by side. The ends 4*i1* (V-shaped ends) of the partition members 4*i* of the cleaning means, which are opposed to the photosensitive drum 4*a*, are arranged not to be aligned with contacting areas (shown by *a, b, c, d* in FIG. 6) between the recording member 2 and the supply rollers 3*a* and the friction pad 3*b* and between the recording member and the regist rollers 3*d*, 3*e*.

Now, the word "not aligned" and the like means the fact that, in FIG. 6, areas P, Q, R extending from the ends 4*i1* of the partition members (opposed to the photosensitive drum) in parallel with a recording member convey direction are situated out of the contacting areas a, b, c, d. Incidentally, in the illustrated embodiment, since the ends 4*i1* of the partition members have V-shaped configurations, the areas P, Q, R extending from the ends 4*i1* have no width. However, when each of the ends has a certain thickness, the areas P, Q, R will have widths corresponding to such thickness.

With this arrangement, even when the paper powder generated due to the friction between the recording member 2, and the supply rollers 3*a* and the friction pads 3*b* and the friction between the recording member and the regist rollers 3*d*, 3*e* goes along the photosensitive drum 4*a* to coagulate together with the waste toner to form the condensations and is collected into the cleaning container 4*d1*, such condensations are collected into the container 4*d1* without passing through the ends 4*i1* of the partition members. Accordingly, the small spaces V formed at the ends of the partition members are not filled with the toner, with the result that the collection of the toner is not obstructed, thus preventing the toner from slipping from the cleaning container.

Incidentally, in the illustrated embodiment, while an example that the supply rollers 3*a* and the friction pads 3*b* are disposed within the total width of the regist rollers 3*d*, 3*e* in the recording member convey direction was explained, the present invention is not limited to this example. For example, it is to be understood that the rollers 3*a* and the pads 3*b* may be arranged offset from the paired regist rollers 3*d*, 3*e*. Further, while an example that the friction pads 3*b* are urged against the supply rollers 3*a* from the bottom was explained, the pads 3*b* may be urged against the rollers 3*a* from the above.

Image Forming Operation

Next, an image forming operation effected by the image forming apparatus having the above-mentioned construction will be explained. The recording members 2 stacked in the supply cassette 1 shown in FIG. 1 are separated one by one by the rotation of the supply roller 3*a*, and the separated recording member is sent to the pair of regist rollers 3*d*, 3*e*. The photosensitive drum 4*a* is rotated in the direction shown by the arrow in FIG. 1 in registration with the convey timing of the paired regist rollers 3*d*, 3*e*, meanwhile the surface of the photosensitive drum 4*a* is uniformly charged by the charger means 4*b*. Then, the image light is illuminated on the photosensitive drum by the scanner portion 10, thereby forming the latent image on the photosensitive drum 4*a*.

At the same time with the latent image formation, the developing means 4*c* in the process cartridge 4 is driven to develop the latent image as the toner image by applying a voltage having the same polarity as the charging polarity of the photosensitive drum 4*a* and substantially the same potential as that of the drum to the developing means so as to adhere the toner to the latent image on the photosensitive drum 4*a*. Thereafter, by applying a voltage having the polarity opposite to that of the toner to the transfer roller 5, the toner image on the photosensitive drum 4*a* is transferred onto the recording member 2.

The recording member 2 to which the toner image was transferred as mentioned above is sent to the fixing station 6 by the convey roller 3*f*. At the fixing station 6, the toner image is permanently fixed to the recording member with heat and pressure. Thereafter, the recording member is ejected on the ejection tray 8 by the ejector rollers 7. On the other hand, the toner remaining on the photosensitive drum 4*a* is collected by the cleaning means 4*d*. In this case, however, since the waste toner is collected into the cleaning container smoothly without spilling as mentioned above, the image can be formed with high quality.

Next, a second embodiment of the present invention will be explained.

Figure 7:
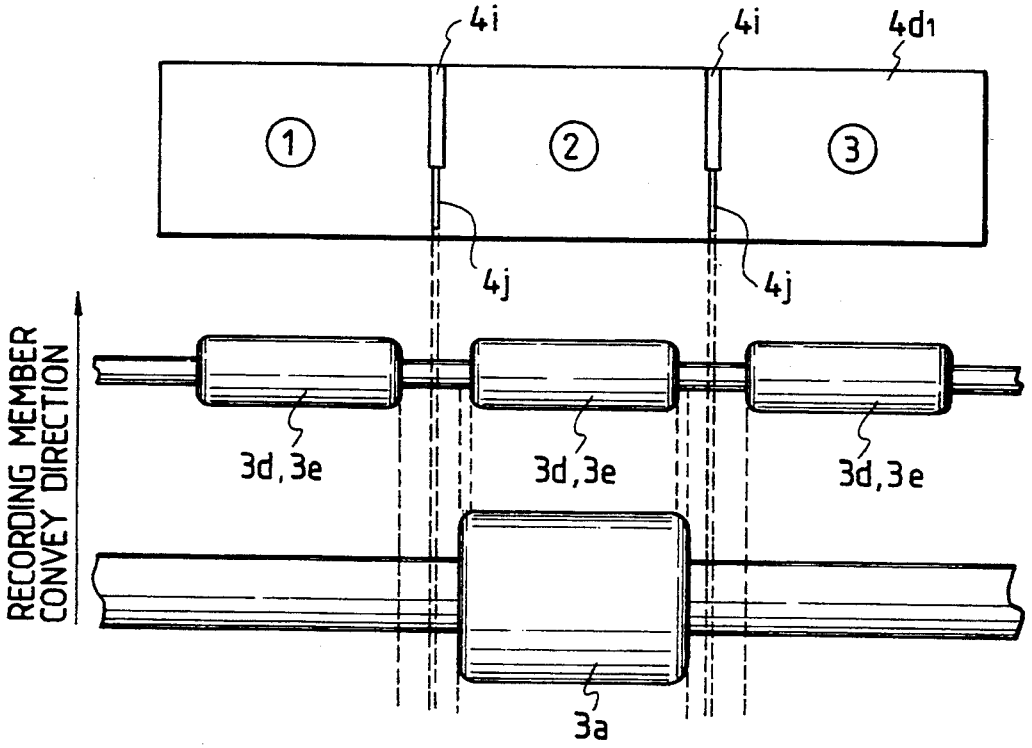
FIG. 7 is a plan view showing a positional relation between partition members of a cleaning container having ends comprised of sheet members, and a supply roller having rounded ends and regist rollers having rounded ends.

In the above-mentioned first embodiment, while an example that the ends of the partition members of the cleaning means 4*d* opposed to the photosensitive drum 4*a* are formed to become V-shaped in order to reduce the thickness of such ends was explained, the ends of the partition members may be constructed as shown in FIG. 7. Incidentally, the process cartridge according to this embodiment is to be loaded in the image forming apparatus described in connection with the first embodiment. Thus, parts having the same function as those shown in the first embodiment will be designated by the same reference numerals.

The cleaning means 4*d* in this embodiment is divided into a plurality of chambers ①-③ by partition members 4*i*, thereby preventing the overflow of the toner due to the offset of the toner in the toner container 4*d1* as in the first embodiment. Each partition member 4*i* is cut at an end thereof opposed to the photosensitive drum 4*a*, and sheet members 4*j* each having a thickness of about 500 μm are attached to the cut ends of the partition members to act as partitions in place of the cut portions of the partition members near the photosensitive drum 4*a*. Each sheet member 4*j* has rigidity sufficient to prevent the collected toner from shifting from one chamber to the other chamber and is made of high lubricant material (tetrafluoroethylene in the illustrated embodiment).

In this way, when the thickness of each partition is reduced at the end thereof near the photosensitive drum and the lubricity thereof is increased by providing the sheet member 4*j*, the waste toner and paper powder are hard to be adhered to the sheet members 4*j*, thereby preventing the waste toner from filling the same spaces, and thus, further preventing the toner from spilling.

Further, as shown in FIG. 7, when both ends of the supply roller 3*a* and the regist rollers 3*d*, 3*e* are rounded, the further effect can be achieved. That is to say, when the recording member 2 is conveyed by the rollers, the paper powder is apt to generate at boundary zones of contacting areas between the recording member and the rollers. Accordingly, when the roller ends are rounded, an amount of the paper powder generated at the roller ends can be suppressed. As a result, the possibility that the waste toner is mixed with the paper powder to coagulate with each other is reduced, whereby the waste toner can be collected into the cleaning container 4*d1* more smoothly. Incidentally, in the illustrated embodiment, a single supply roller 3*a* is used and a width of the supply roller 3*a* is slightly greater than those of the regist rollers 3*d*, 3*e*. In this case, when the recording member 2 is fed from the supply cassette 1 by the rotation of the supply roller 3*a*, the recording members 2 are separated one by one by separating claws (not shown).

Next, a third embodiment of the present invention will be explained.

Figure 8:
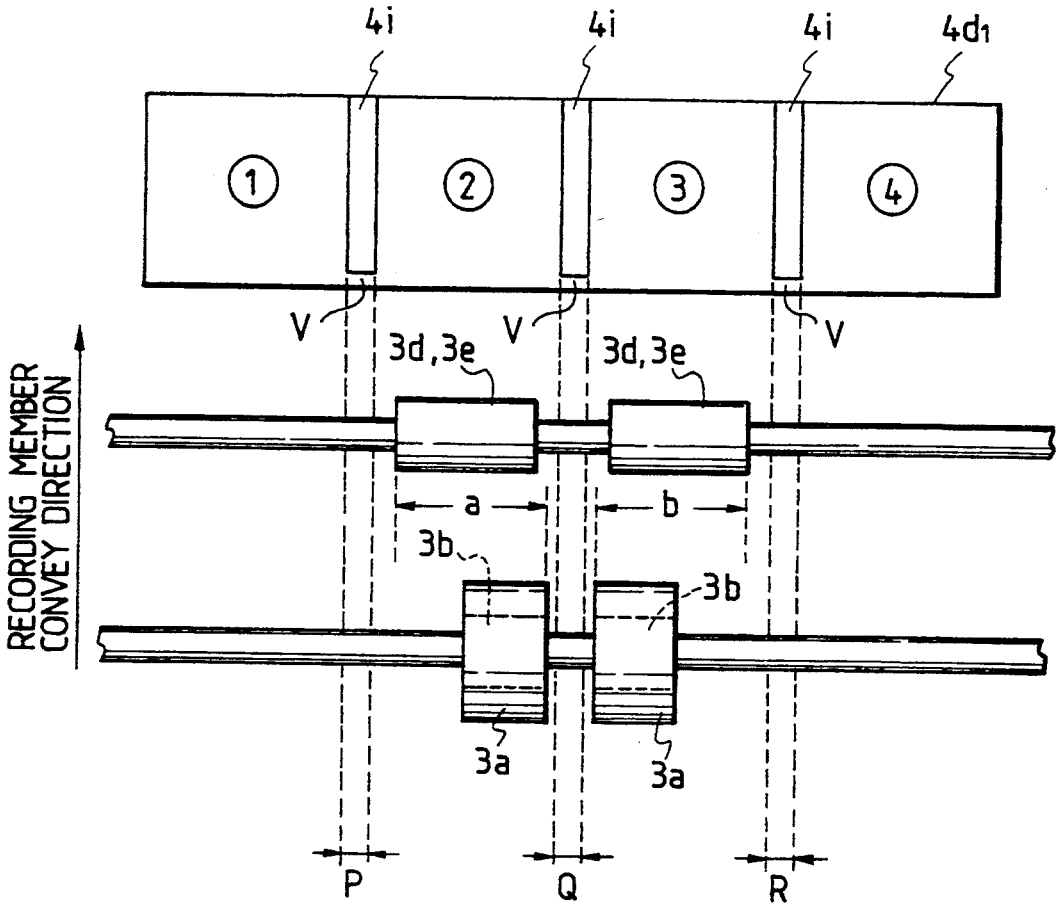
FIG. 8 is a plan view showing a positional relation between partition members of a cleaning container each having a predetermined thickness, and supply rollers and regist rollers.

In the aforementioned first and second embodiments, examples that the ends of the partition members for dividing the cleaning container 4*d1* (into a plurality of chambers) near the photosensitive drum are formed as the V-shaped configurations or are constituted by the sheet members were explained. However, as shown in FIG. 8, it is not necessary to reduce the thickness of each of the ends of the partition members so long as the contacting areas (ranges a and b in FIG. 8) between the recording member 2, and the supply rollers 3*a* and the friction pads 3*b* and between the recording member and the paired regist rollers 3*d*, 3*e* are not aligned with the ends of the partition members 4*i* near the photosensitive drum 4*a* (ranges P, Q and R in FIG. 8).

That is to say, if the paper powder generated due to the friction between the recording member 2, and the supply rollers 3*a* and the friction pads 3*b* and between the recording member and the paired regist rollers 3*d*, 3*e* goes along the photosensitive drum 4*a* and is coagulated together with the waste toner to form the condensations, the condensations are collected into the container 4*d1* without passing through the ends of the partition members. Thus, the small spaces V formed at the ends of the partition members are not filled with the condensated toner, whereby the waste toner can be collected into the container 4*d1* smoothly.

Next, a fourth embodiment of the present invention will be explained.

While only the positional relation between the partition members 4*i* and the paired regist rollers 3*d*, 3*e* and between the partition members and the supply roller(s) 3*a* and the friction pad(s) 3*b* was explained in the above-mentioned embodiments, when a relation between the partition members 4*i* and sizes of the recording members 2 to be conveyed is selected as follows, the effective result can be achieved.

Figure 9:
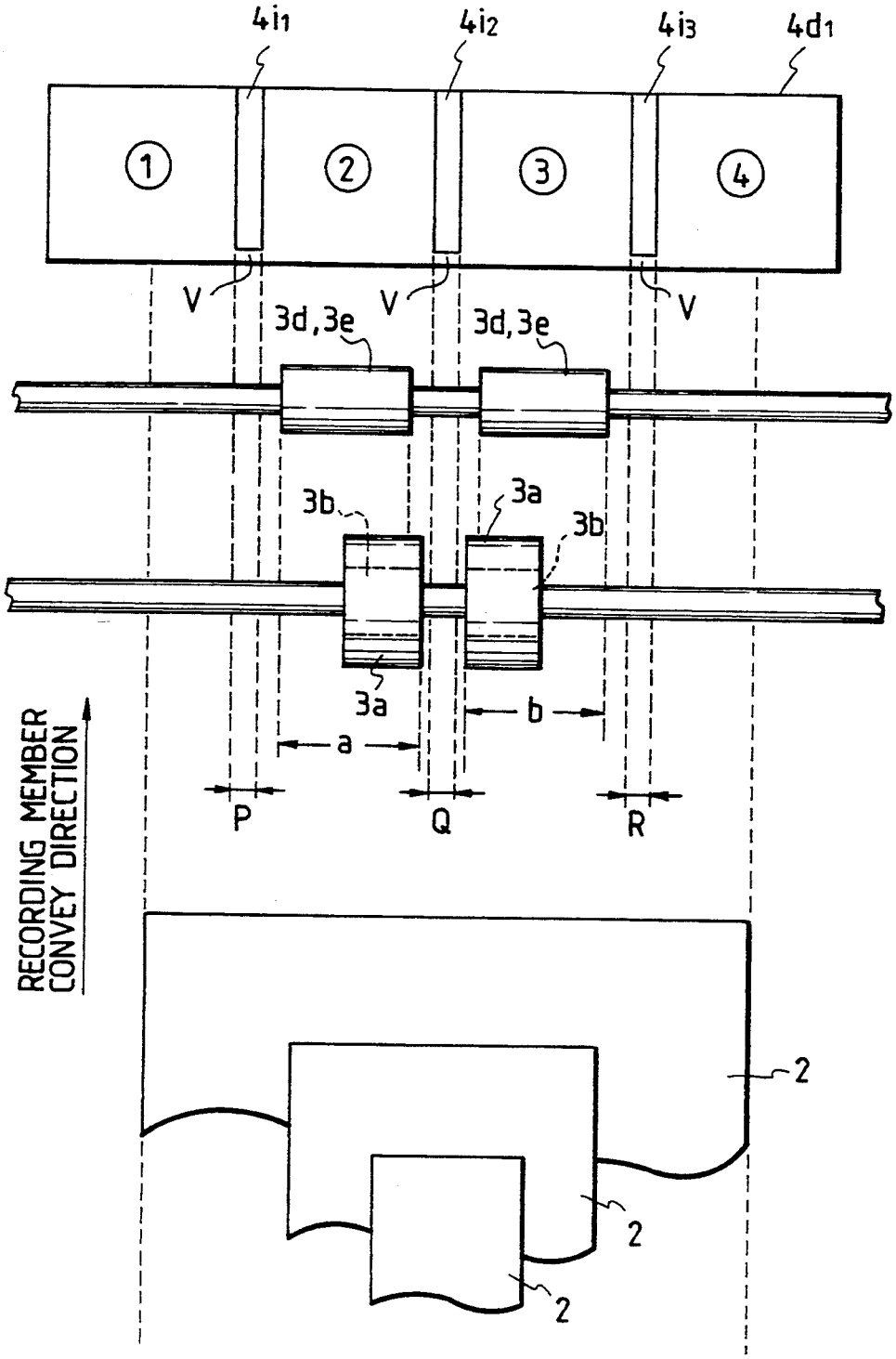
FIG. 9 is a plan view showing a positional relation between partition members of a cleaning container, and supply rollers and regist rollers, and widths of various recording members.

In this fourth embodiment, although the fundamental construction is the same as that in the above-mentioned third embodiment, as shown in FIG. 9, the ends of the partition members 4*i* for dividing the cleaning container 4*d1* (into a plurality of chambers) near the photosensitive drum 4*a* are not aligned with widthwise lateral edges of any recording members 2 to be used in the recording member convey direction.

The sizes of the recording members 2 which can be used with this image forming apparatus are generally A3 size, A4 size, A5 size, B4 size, B5 size, letter size, post card size and name card size. In the present invention, when any recording member 2 having one of these sizes is conveyed through the image forming apparatus, the widthwise lateral edges of the recording member 2 are not aligned with the ends of the partition members in the recording member convey direction. More particularly, in a case where the recording member is conveyed in connection with a center reference, as shown in FIG. 9, when the cleaning container 4*d1* is divided into chambers ①-④ by three partition members 4*i1*, 4*i2*, 4*i3*, a central partition member 4*i2* is arranged at a central portion with respect to the recording member 2 to be conveyed in a widthwise direction thereof, and two both side partition members 4*i1*, 4*i3* are arranged at positions spaced apart from the central partition member 4*i2* by a distance of 58 mm, respectively, in the widthwise direction.

Since the widthwise lateral edges of the recording member 2 are apt to generate a large amount of paper powder particularly, even when such widthwise lateral edges are not directly contacted with the regist rollers 3*d*, 3*e*, the supply roller(s) 3*a* and the friction pad(s) 3*b*, the paper powder can be generated only when the recording sheet is subjected to the pressure between the transfer roller 5 and the photosensitive drum 4*a*. Of course, if the widthwise lateral edges of the recording member 2 are directly contacted with the regist rollers 3*d*, 3*e*, the supply roller(s) 3*a* and the friction pad(s) 3*b*, a larger amount of paper powder will generate.

As mentioned above, with the arrangement wherein the widthwise lateral edges of the recording member 2 are not aligned with the ends (forming the zones P, Q, R) of the partition members 4*i* near the photosensitive drum 4*a* in the recording member convey direction, since the portions of the recording member 2 which may be generate a larger amount of paper powder (i.e., both widthwise lateral edges of the recording member and portions of the recording member corresponding to the areas a and b) do not pass through the zones P, Q, R corresponding to the ends of the partition members 4*i*, the small spaces V formed at the ends of the partition members are not filled with the paper powder/toner condensations, thereby preventing the waste toner from spilling.

Next a fifth embodiment of the present invention will be explained.

Figure 10:
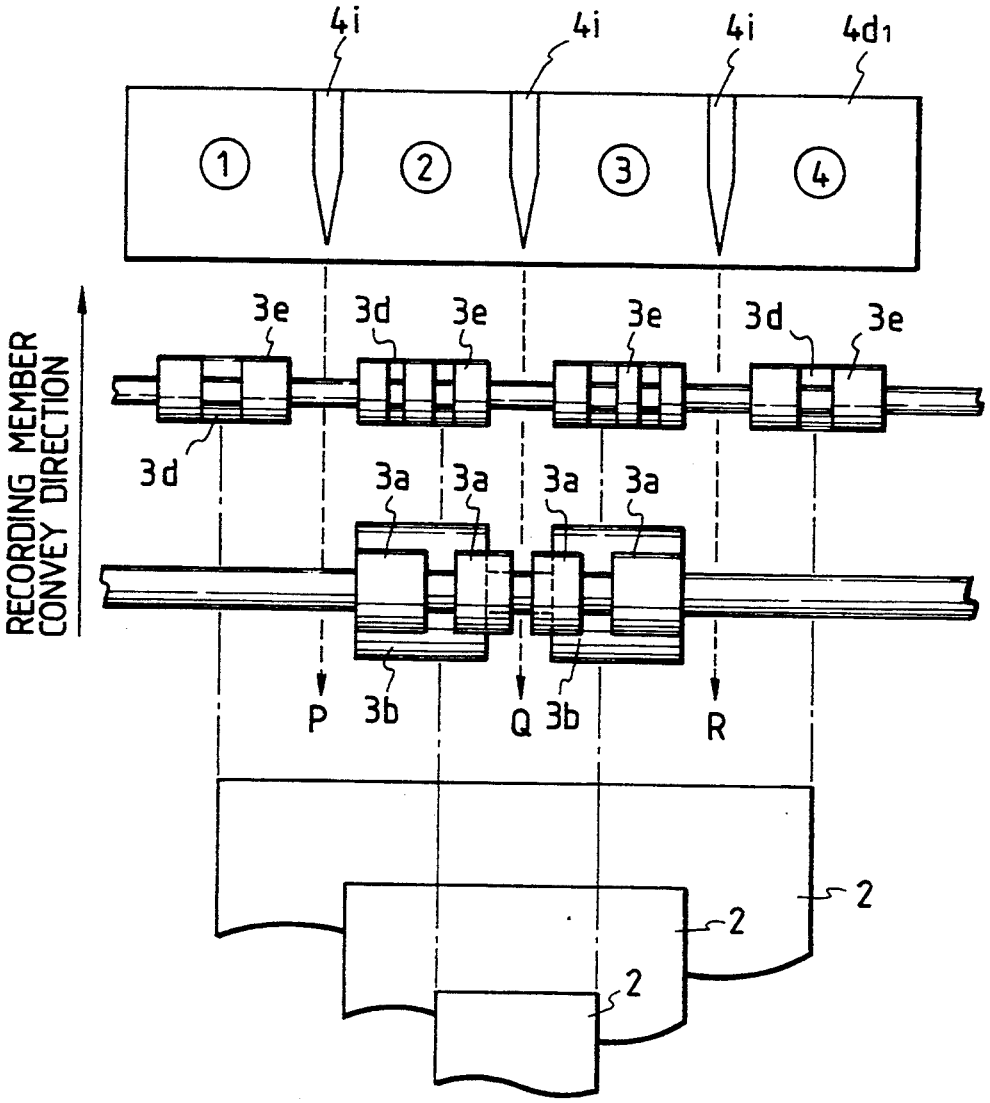
FIG. 10 is a plan view showing an embodiment wherein various recording members can be fed by supply rollers and regist rollers in such a manner that lateral edges (in a widthwise direction) of the recording members are not pinched by the rollers.

As an alteration of the aforementioned fourth embodiment, as shown in FIG. 10, it is more preferable that the both lateral edges of the recording member 2 are not pinched by the paired regist rollers 3*d*, 3*e* since the generation of the paper powder can be further supressed. More particularly, as shown in FIG. 10, the supply roller 3*a* is divided into a plurality of roller portions so as not to align with the zones P, Q, R of the partition members 4*i* of the cleaning container and both widthwise lateral edges of various recording members 2 which can normally be used, in the recording member convey direction. Further, the lower regist rollers 3*d* are also divided so as not to align with the zones P, Q, R of the partition members 4*i* of the cleaning container. In addition, the upper regist rollers 3*e* are also divided so as not to align with the zones P, Q, R of the partition members 4*i* of the cleaning container and both widthwise lateral edges of various recording members 2 which can normally be used, similar to the lower regist rollers 3*d*.

With this arrangement, since the widthwise lateral edges of the recording member 2 is not pinched between the supply roller 3*a* and the friction pad 3*b* and between the paired regist rollers 3*d*, 3*e*, the rollers are not deflected, thereby eliminating the difference in contacting pressure between each roller and the recording member 2. Thus, the generation of the paper powder at the both widthwise lateral edges of the recording member 2 can be suppressed, thereby preventing the ends of the partition members 4*i* from being filled with the waste toner more effectively.

Incidentally, in the embodiment shown in FIG. 10, the ends of the partition members 4*i* near the photosensitive drum are made V-shaped as in the first embodiment. Also from this arrangement, the ends of the partition members cannot easily be filled with the waste toner.

Next, a sixth embodiment of the present invention will be explained.

Figure 11:
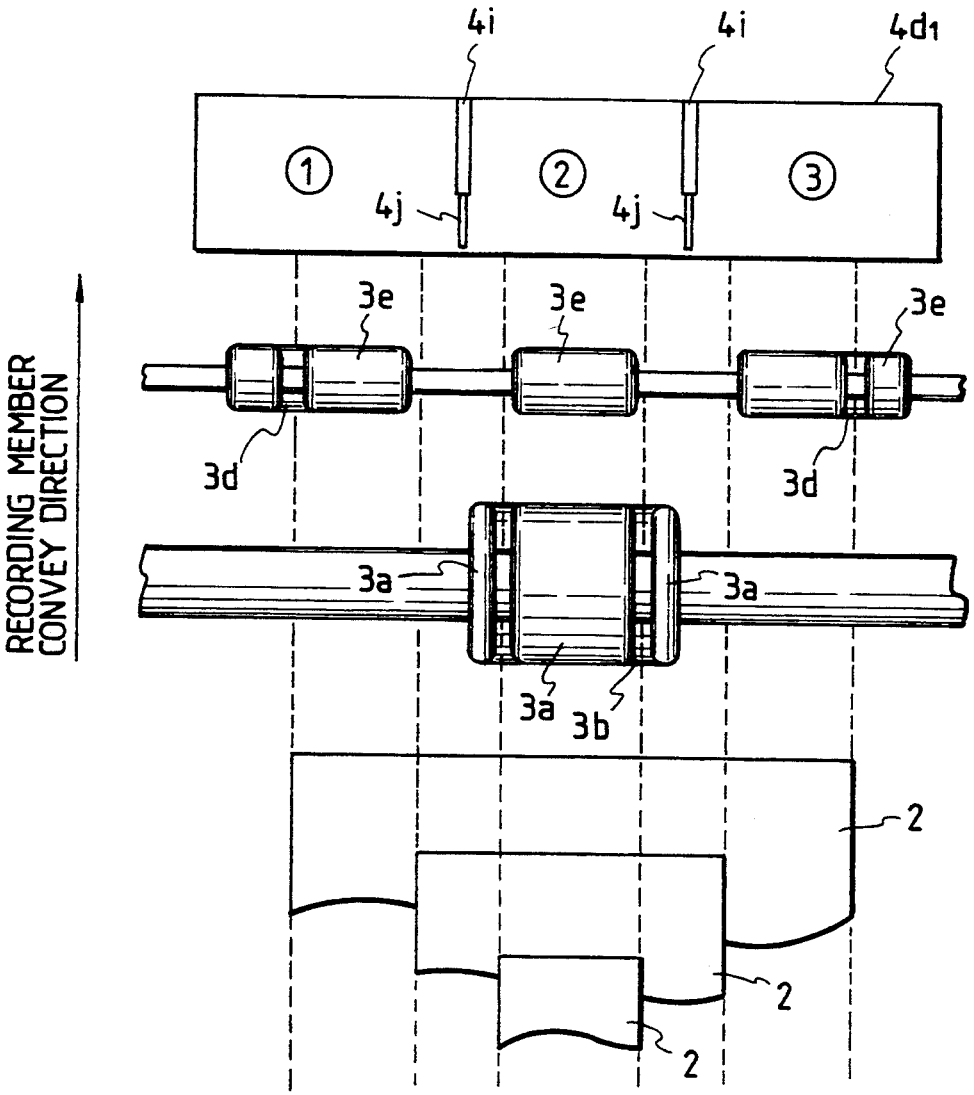
FIG. 11 is a plan view showing an embodiment wherein various recording members can be fed by supply rollers having rounded ends and regist rollers having rounded ends in such a manner that lateral edges (in a widthwise direction) of the recording members are not pinched by the rollers.

As an alteration of the fifth embodiment, as shown in FIG. 11, when the both lateral edges of the recording member 2 are not pinched by the supply roller 3*a* and the friction pad 3*b* and by the paired regist rollers 3*d*, 3*e* and when the both ends of each roller are rounded, it is possible to suppress the generation of the paper powder more effectively, thus preventing the ends of the partition members 4*i* from being filled with the waste toner. Further, as shown in FIG. 11, when the high lublicant sheet members 4*j* is provided at the ends of the partition members 4*i* near the photosensitive drum as in the second embodiment, the small spaces at these ends can be prevented from being filled with the waste toner more effectively.

Next, a seventh embodiment of the present invention will be explained.

Figure 12:
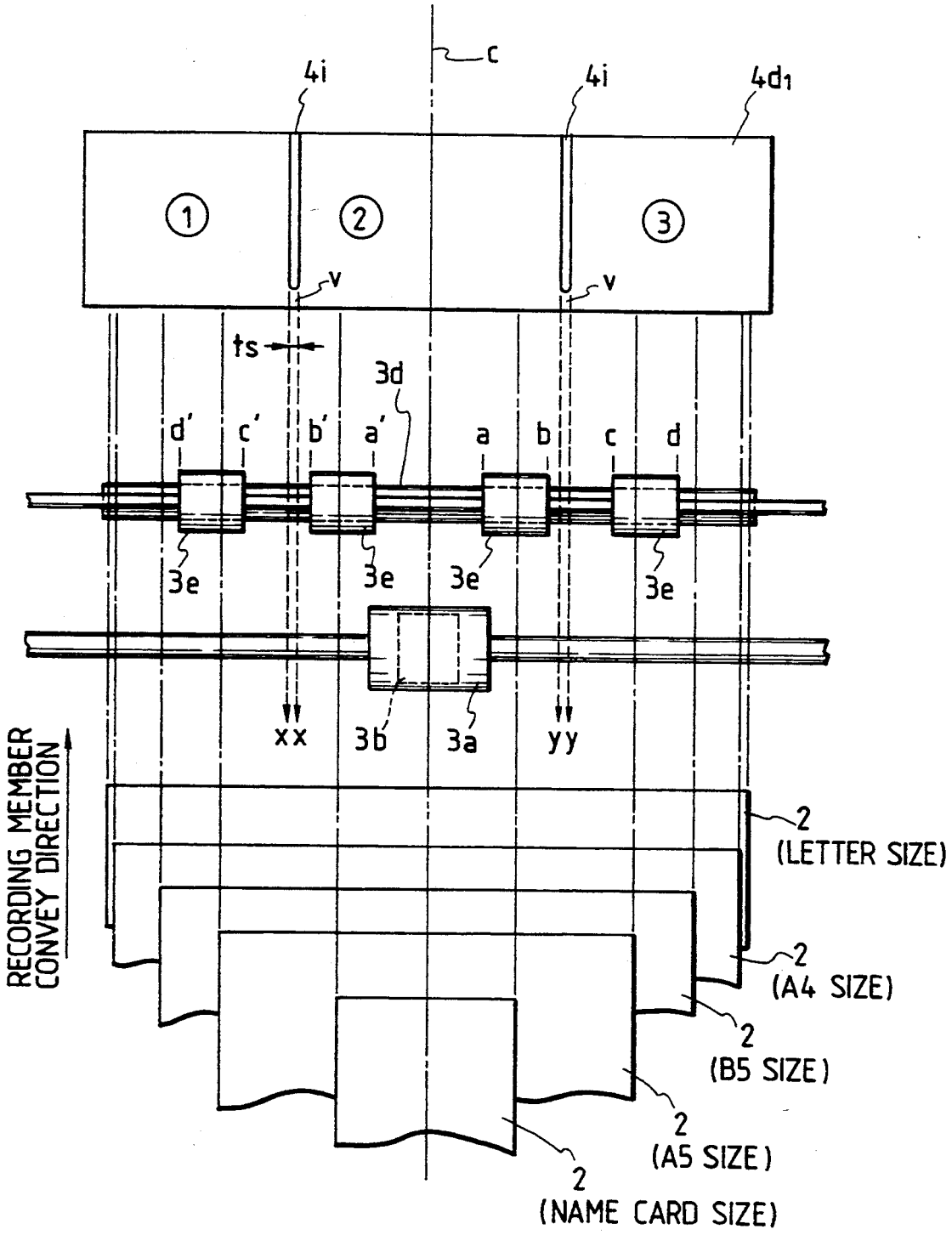
FIG. 12 is a plan view showing an embodiment wherein ends of partition members are rounded.
Figure 13:
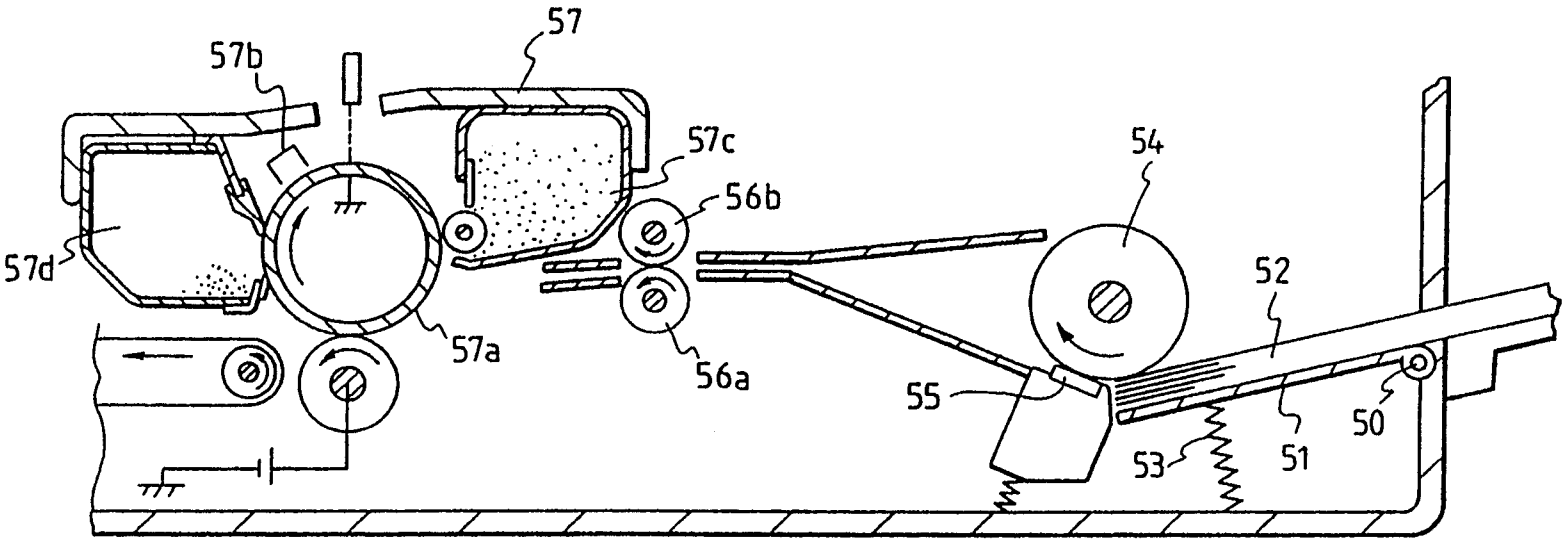
FIG. 13 PRIOR ART
FIG. 13 is a schematic elevational sectional view of a conventional image forming apparatus.
Figure 14:
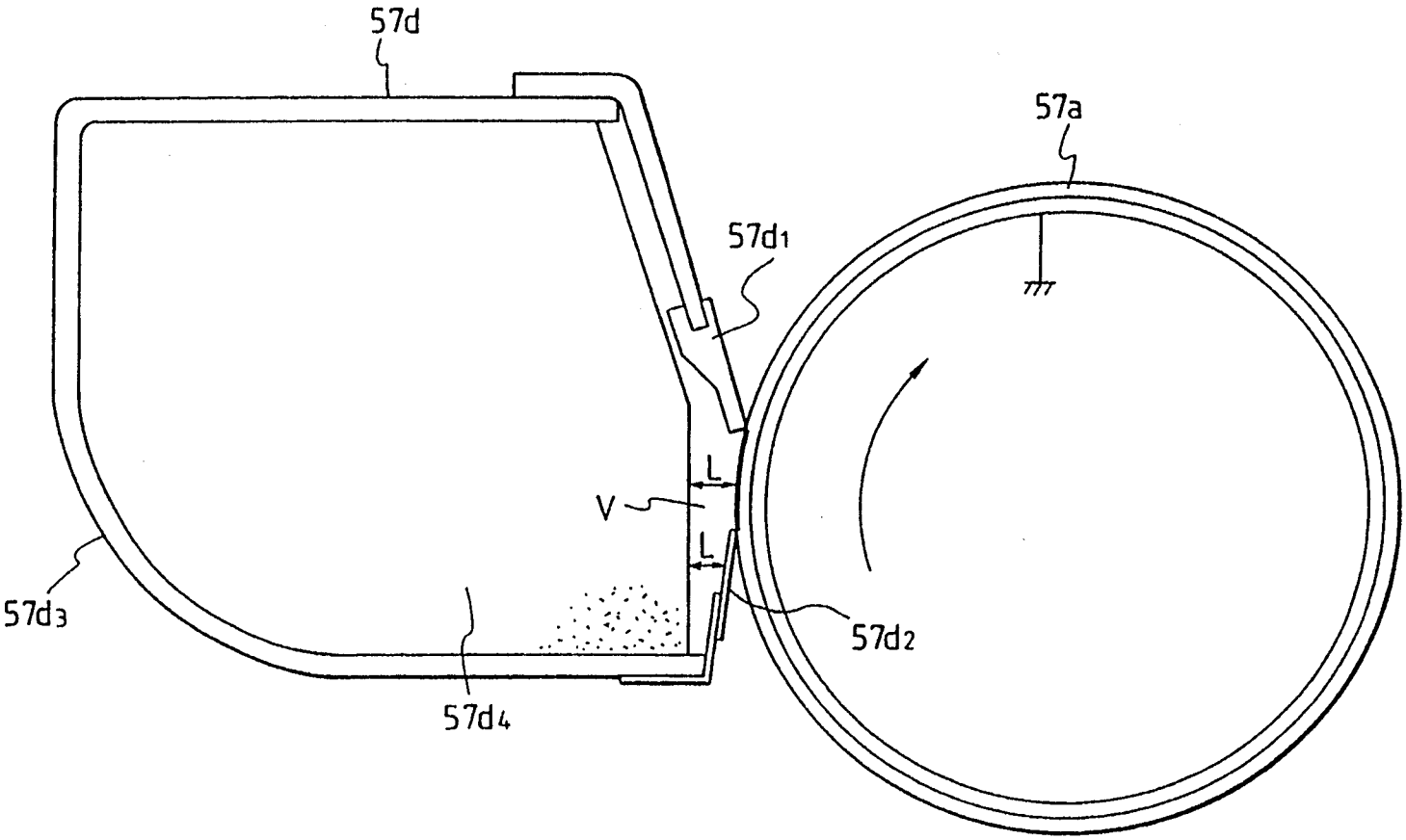
FIG. 14 PRIOR ART
FIG. 14 is a sectional view for explaining a small space is formed at an end of a partition member of a conventional cleaning container.
Figure 15:
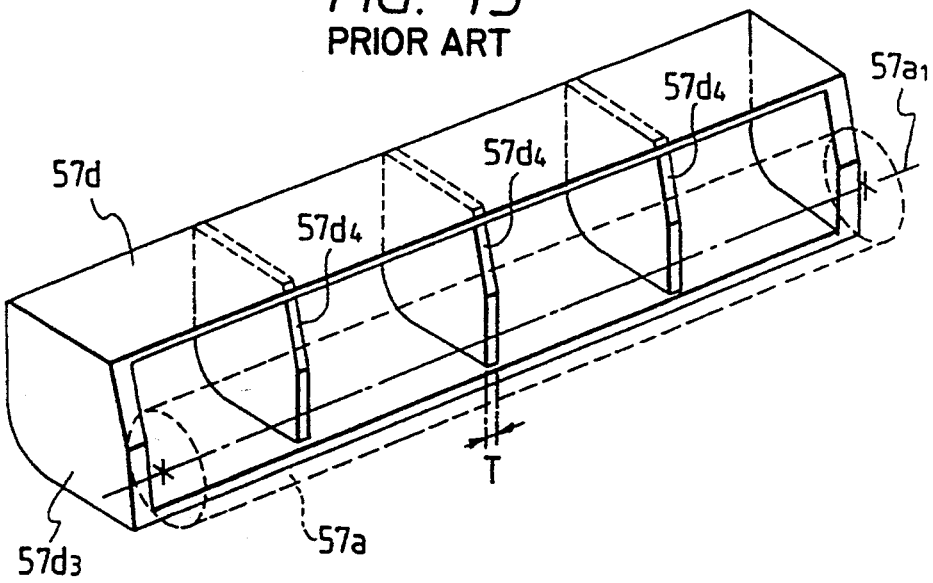
FIG. 15 PRIOR ART
FIG. 15 is a perspective view of the conventional cleaning container.
Figure 16:
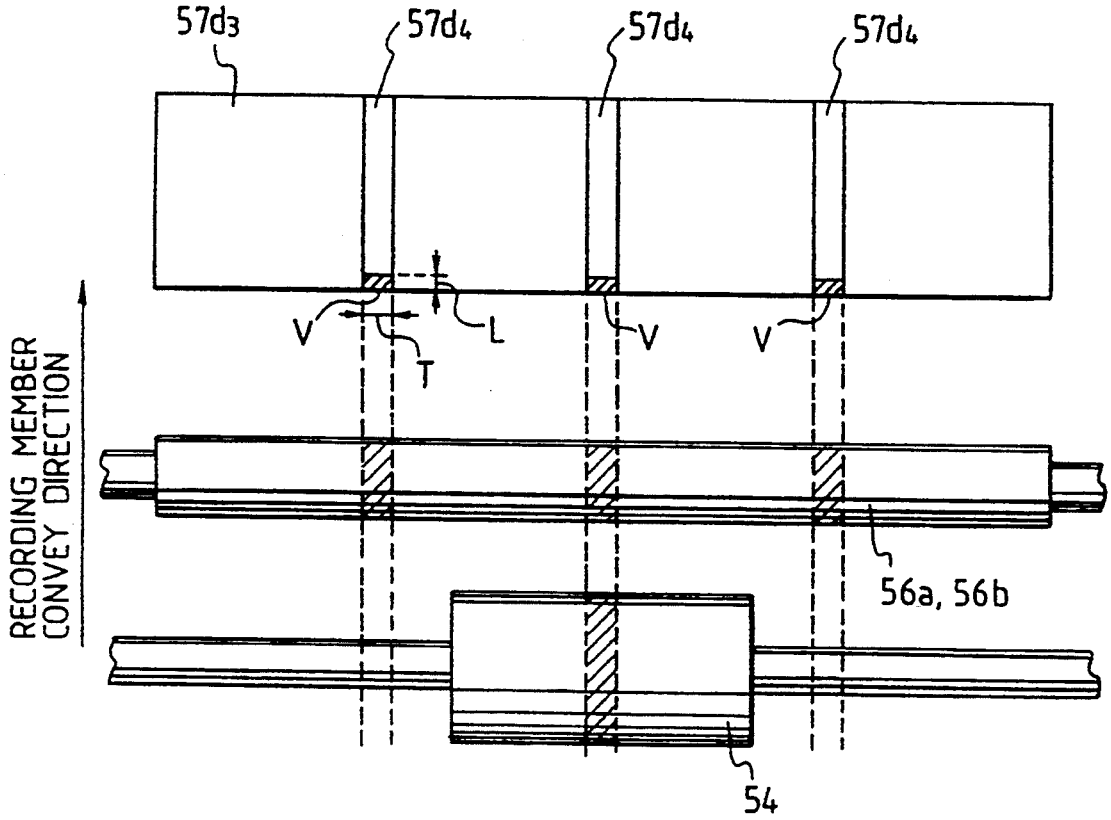
FIG. 16 PRIOR ART
FIG. 16 is a plan view showing a positional relation between partition members of the conventional cleaning container, and a supply roller and regist rollers.
Figure 17:
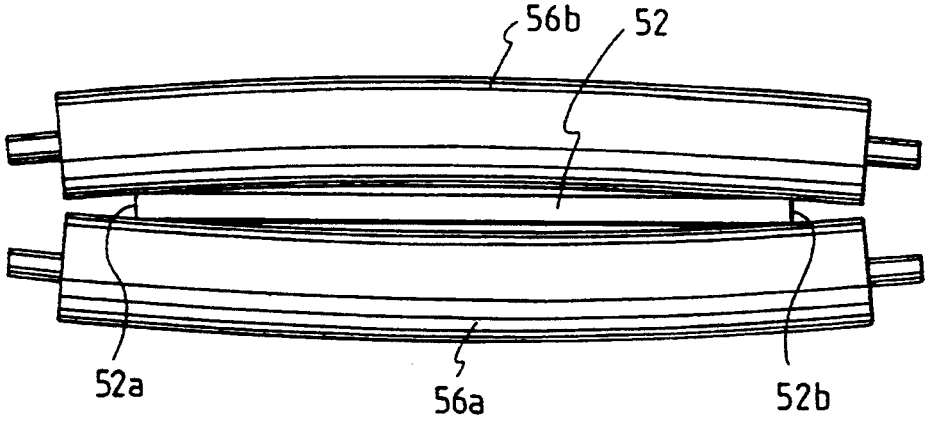
FIG. 17 PRIOR ART
FIG. 17 is a view showing the deflection of rollers generated when a recording member is fed by a conventional pair of rollers.
Figure 18:
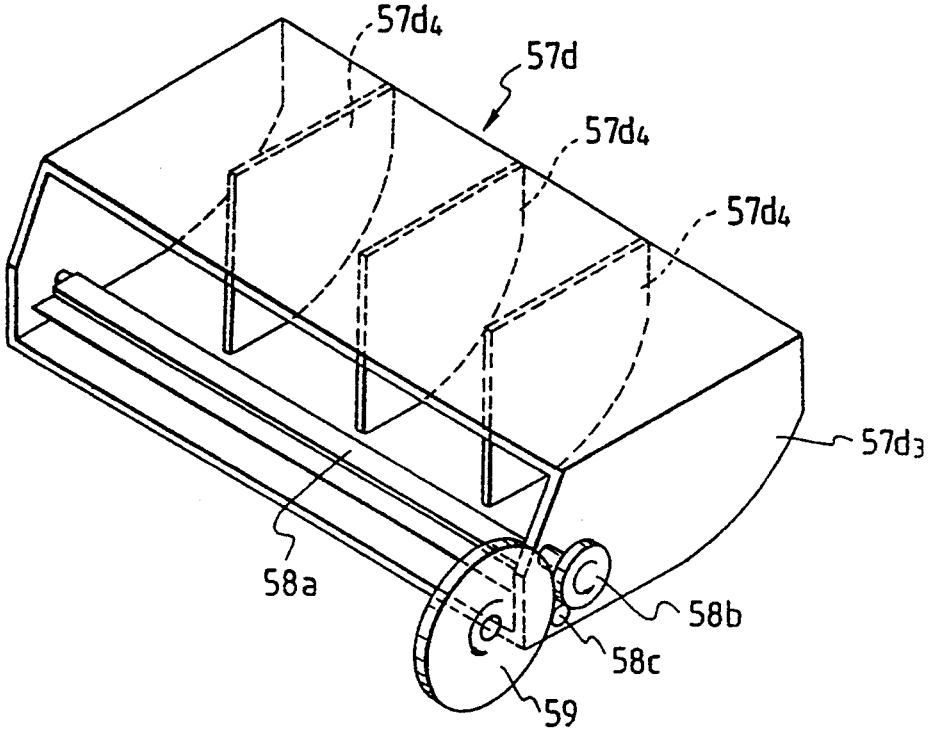
FIG. 18 PRIOR ART
FIG. 18 is a perspective view of a conventional cleaning means having a mechanism for feeding waste toner.

In the aforementioned embodiments, while examples that the ends of the partition members 4*i* near the photosensitive drum are made V-shaped or are constituted by the sheet members to make such ends thinner were explained, as shown in FIG. 12, even when the ends of the partition members are rounded, it is possible to prevent the small spaces V from being filled with the waste toner.

In the embodiment shown in FIG. 12, the cleaning container 4*d1* is divided into three chambers ①-③ by two partition members 4*i*, thereby preventing the offset of the waste toner. Since each partition member 4*i* has a thickness ts, the partition members and the opposed surface of the photosensitive drum form small spaces V therebetween at zones a—a, b—b in an axial direction of the photosensitive drum 4*a*. However, since the ends of the partition members 4*i* near the photosensitive drum are rounded, the waste toner is moved into the left and right chambers of the cleaning container 4*d1* without remaining on the rounded ends of the partition members, thereby preventing the small spaces V from being filled with the waste toner.

Further, in this embodiment, the positional relation between the recording member 2, partition members 4*i*, supply roller 3*a* and friction pad 3*b*, and paired regist rollers 3*d*, 3*e* is selected as follows. Incidentally, in this embodiment, as shown in FIG. 12, a letter size sheet, A4 size sheet, B5 size sheet, A5 size sheet and name card size sheet can be conveyed as the recording members. That is to say, the two partition members 4*i* are spaced apart from a centerline C of the recording member 2 in its widthwise direction by 44.5 mm and are symmetrically arranged left and right with respect to the centerline, and the regist rollers 3*e* divided into four roller portions are also symmetrically arranged left and right with respect to the centerline C of the recording member 2 so that end surfaces a—a', b—b', c—c' and d—d' of the roller portions are spaced apart from the centerline C by 19.3 mm, 39.7 mm, 63.8 mm and 84.2 mm, respectively. Further, centerlines of the supply roller 3*a* and the friction pad 3*b* in their widthwise directions coincide with the centerline C of the recording member 2, and ends surfaces of the supply roller and end surfaces of the friction pad are spaced apart from the centerline C by 20 mm and 12.5 mm, respectively.

With the arrangement as mentioned above, the both widthwise lateral edges of the recording member 2 and the partition members 4*i* are not aligned with each other in the recording member convey direction, and the supply roller 3*a* and the regist rollers 3*d*, 3*e* and the partition members 4*i* are also not aligned with each other in the recording member convey direction. As a result, even when the paper powder generated at the widthwise lateral edges of the recording member 2 and generated due to the friction between the rollers and the recording member goes along the photosensitive drum 4*a* to be collected into the cleaning container 4*d1* while mixing with the waste toner to form the condensations, the small spaces formed between the photosensitive drum 4*a* and the partition members 4*i* are not filled with the waste toner. Thus, even by using the cleaning means not having the waste toner feed mechanism, it is possible to prevent the waste toner from spilling from the cleaning container effectively.

Incidentally, also when an A3 size sheet, B4 size sheet and post card size sheet are used as recording members, by utilizing the arrangement for preventing the above-mentioned alignment, a further effect can be obtained.

Next, the test result effected regarding the printer described in connection with the background art and the printer according to the embodiment to which the present invention is applied will be described.

A roller made of neoprene rubber (JIS A hardness of 20°±5°) and having a diameter of about 26 mm and a width of about 40 mm was used as the supply roller 3*a*. Further, a piece made of urethane rubber including cork of about 30% and having a width of about 25 mm was used as the friction pad 3*b*. And, the urethane rubber piece was urged against the neoprene rubber roller by a spring 3*h* with the total pressure of about 175 grams.

Further, four rollers each made of iron and having a diameter of about 9 mm were used as the regist roller 3*d*, 6and four rollers each made of neoprene rubber (JIS A hardness of about 60°±5°) and having a diameter of about 10 mm and a width of about 20.4 mm were used as the regist rollers 3*e*, and these rollers were disposed in the recording member convey path along the widthwise direction of the recording member. The rollers 3*d*, 3*e* were urged against each other with the total pressure of about 1.5 kg.

As a result that the tests were effected by using the above-mentioned supply mechanism, it was found that, in the printer described in connection with the background art, when the image formation was effected by using the regenerated sheets (EN-500, manufactured by SANYO KOKUSAKU PULP Co., Ltd.), the paper powder and developer were coagulated and were dropped down after the images had been formed on about 2,000 sheets. Further, it was found that, when the image formation was effected by using so-called plain paper sheets (SK paper sheets, manufactured by SANYO KOKUSAKU PULP Co., Ltd.), the paper powder and developer were sometimes coagulated and were dropped down after the images had been formed on about 3,000 sheets.

On the other hand, in the printer according to the present invention, even when the above-mentioned both sheets (regenerated sheets and plain paper sheets) were used, it was found that the paper powder/- developer condensations were not spilled after the images had been formed on at least 3,000 sheets, and the good images were obtained.

Next, the other embodiments of the present invention will be explained.

In the aforementioned embodiments, the waste toner does not remain at the ends of the partition members of the cleaning means by thinning the thickness of each end. Now, the wording "thin a thickness of an end" means that not only the end is made V-shaped, or is rounded, or the sheet member is provided at the end as mentioned above, but also the end is appropriately configured not to retain the waste toner at the end.

The process cartridge 4 according to the present invention can be used to form a mono-color image as mentioned above, and also can be applied to a cartridge including a plurality of developing means 4c to form a plural color image (for example, two-color image, three-color image or full-color image). Further, a developing method may be conventional one, for example, of two-component magnetic brush developing type, cascade developing type, touch-down developing type, claud developing type or the like.

Regarding the charger means, while the charger means of so-called contact charging type was used in the first embodiment, a conventional charger means wherein it comprises three side walls formed by tungsten wires and a metal (for example, aluminum) shield enclosing the walls, and positive or negative ions generated by applying high voltage to the tungsten wires are transferred to the surface of the photosensitive drum 4a, thereby uniformly charging the surface of the photosensitive drum 4a may be used.

Further, the cleaning means for removing the toner remaining on the photosensitive drum 4a may comprise a blade, fur brush, magnetic brush or the like.

Furthermore, the aforementioned process cartridge 4 includes therein an electrophotographic photosensitive member as an image bearing member, and at least a cleaning means. Accordingly, other than the above-mentioned embodiments, the process cartridge may integrally incorporated therein a charger means as well as the image bearing member and the cleaning means as a unit which can be removably mounted within the image forming apparatus, or may integrally incorporate therein a developing means as well as the image bearing member and the cleaning means as a unit which can be removably mounted within the image forming apparatus, or may integrally incorporate therein only the image bearing member and the cleaning means as a unit which can be removably mounted within the image forming apparatus.

Further, in the above-mentioned embodiments, while an example that the laser beam printer is embodied as the image forming apparatus was explained, the present invention is not limited to this example, but may be applied, for example, to an electrophotographic copying machine, an LED printer, a facsimile, a word processor or other image forming apparatuses.

As mentioned above, since the developer receiving portion of the cleaning means is divided into a plurality of chambers by the partition members extending in the direction perpendicular to the rotation axis of the image bearing member and the ends of the partition members near the image bearing member are thinned, the developer removed from the image bearing member does not fill the small spaces formed between the ends of the partition members and the image bearing member, thereby collecting the waste toner in the receiving portion of the cleaning means smoothly.

Further, since the ends of the partition members of the cleaning means near the image bearing member are not aligned with the contacting areas between the recording member convey means and the recording member in the recording member convey direction or the ends of the partition members of the cleaning means near the image bearing member are not aligned with the widthwise lateral edges of the recording member to be conveyed by the convey means in the recording member convey direction, the developer coagulated together with the paper powder generated due to the conveyance of the recording member does not pass through the aforesaid ends of the partition members, thus preventing the developer/paper powder condensations from filling the small spaces formed at the aforesaid ends. Accordingly, since the developer on the image bearing member can be smoothly collected even if the developer feed mechanism for feeding the developer collected in the cleaning means is not additionally provided, it is possible to reduce the number of parts, which results in the cost-down, and to make the process cartridge and the image forming apparatus small-sized.

As mentioned above, according to the present invention, it is possible to provide a cleaning mechanism, an image forming apparatus and an image forming system which can obtain an image with high quality and improve the cleaning ability remarkably.

Further, according to the present invention, the regenerated paper sheets can be used as recording members, thus greatly contributing to the protection of the environment on the earth.

What is claimed is:

1. A cleaning mechanism, for use with an image forming apparatus that forms an image on a recording medium using an image bearing member having a rotational axis and that conveys the recording medium using convey means, said cleaning mechanism comprising:

cleaning means for removing residual matter from the image bearing member;

receiving means, disposed along a rotational axis of the image bearing member, for receiving the residual matter removed from the image bearing member by said cleaning means; and at least one partition member, disposed in a direction orthogonal to the rotational axis of the image bearing member, for partitioning said receiving means, each said partition member having a tip end opposing the image bearing member and the tip end of each said partition member being aligned with a non-contacting area between the recording medium and the convey means located upstream of the image bearing member in a recording medium convey direction.

2. A cleaning mechanism according to claim 1, wherein said receiving means comprises a container for containing residual matter removed from the image bearing member by said cleaning means, and each said partition member is disposed within said container to regulate movement of the residual matter being contained in said container.

3. A cleaning mechanism according to claim 1, wherein the tip end of each said partition member opposing the image bearing member is aligned with an area apart from widthwise lateral edges of the recording medium in the recording medium convey direction.

4. A cleaning mechanism according to claim 1, wherein the tip end of each said partition member opposing the image bearing member has a thickness smaller than that of a base of each said partition member.

5. A cleaning mechanism according to claim 1, wherein the tip end of said partition member opposing the image bearing member comprises material having high lubricity.

6. A cleaning mechanism according to claim 1, wherein the tip end of each said partition member opposing the image bearing member is sharpened.

7. A cleaning mechanism according to claim 1, wherein size of the recording medium is at least one of an A3 size, A4 size, A5 size, B4 size, B5 size, letter size, post card size and name card size.

8. A cleaning mechanism according to claim 1, wherein the convey means comprises a roller and a friction pad urged against the roller to separate recording media supplied from a supply cassette one by one.

9. A cleaning mechanism according to claim 1, wherein the convey means comprises a plurality of rollers spaced apart from each other in a widthwise direction of a convey path for the recording medium.

10. An image forming apparatus for forming an image on a recording medium, said image forming apparatus comprising:

an image bearing member having a rotational axis;

developing means for developing a latent image formed on said image bearing member;

transfer means for transferring an image developed by said developing means onto the recording medium;

cleaning means for removing developer remaining on said image bearing member after the transferring operation;

receiving means, disposed along a rotational axis of said image bearing member, for receiving the developer removed from said image bearing member by said cleaning means;

convey means for conveying the recording medium; and at least one partition member, disposed in a direction orthogonal to the rotational axis of said image bearing member, for partitioning said receiving means, each said partition member having a tip end opposing said image bearing member and the tip end being aligned with a non-contacting area between the recording medium and said convey means located upstream of said image bearing member in a recording medium convey direction.

11. An image forming apparatus according to claim 10, wherein said receiving means comprises a container for containing developer removed from said image bearing member by said cleaning means, and each said partition member is disposed within said container to regulate movement of the developer being contained in said container.

12. An image forming apparatus according to claim 10, wherein the tip end of each said partition member opposing said image bearing member is aligned with an area apart from widthwise lateral edges of the recording medium in the recording medium convey direction.

13. An image forming apparatus according to claim 10, wherein the tip end of each said partition member opposing said image bearing member has a thickness smaller than that of a base of each said partition member.

14. An image forming apparatus according to claim 10, wherein the tip end of each said partition member opposing said image bearing member comprises material having high lubricity.

15. An image forming apparatus according to claim 10, wherein the tip end of each said partition member opposing said image bearing member is sharpened.

16. An image forming apparatus according to claim 10, wherein a size of the recording medium is at least one of an A3 size, A4 size, A5 size, B4 size, B5 size, letter size, post card size and name card size.

17. An image forming apparatus according to claim 10, wherein said image bearing member comprises a photosensitive drum and said cleaning means comprises an elastic cleaning blade, and wherein said elastic cleaning blade removes residual developer on said photosensitive drum.

18. An image forming apparatus according to claim 10, wherein said convey means contacts with the recording medium to convey said recording medium using a friction force between said convey means and said recording medium.

19. An image forming apparatus according to claim 10, wherein said convey means comprises a roller and a friction pad urged against said roller to separate recording media supplied from a supply cassette one by one.

20. An image forming apparatus according to claim 10, wherein said convey means comprises a plurality of rollers spaced apart from each other in a widthwise direction of a convey path for the recording medium.

21. An image forming apparatus which forms an image on a recording medium and within which a process cartridge can be removably mounted, said image forming apparatus comprising:

convey means for conveying the recording medium;

mounting means for mounting a process cartridge which includes an image bearing member having a rotational axis, cleaning means for removing developer on said image bearing member, receiving means, disposed along a rotational axis of said image bearing member, for receiving the developer removed from said image bearing member by said cleaning means, and a partition member, disposed in a direction orthogonal to the rotational axis of said image bearing member, for partitioning said receiving means, each said partition member having a tip end opposing said image bearing member and said mounting means mounting said process cartridge so that the tip end of each said partition member of said process cartridge opposing said image bearing member is aligned with a non-contacting area between the recording medium and said convey means located upstream of said image bearing member in a recording medium convey direction; and transfer means for transferring a developed image formed on said image bearing member of said process cartridge onto the recording medium.

22. An image forming apparatus according to claim 21, wherein said receiving means comprises a container for containing the developer removed from said image bearing member by said cleaning means, and each said partition member is disposed within said container to regulate movement of the developer being contained in said container.

23. An image forming apparatus according to claim 21, wherein the tip end of each said partition member opposing said image bearing member is aligned with an area apart from widthwise lateral edges of the recording medium in the recording medium convey direction.

24. An image forming apparatus according to claim 21, wherein the tip end of each said partition member opposing said image bearing member has a thickness smaller than that of a base of each said partition member.

25. An image forming apparatus according to claim 21, wherein the tip end of each said partition member opposing said image bearing member comprises material having high lubricity.

26. An image forming apparatus according to claim 21, wherein the tip end of each said partition member opposing said image bearing member is sharpened.

27. An image forming apparatus according to claim 21, wherein a size of the recording medium is at least one of an A3 size, A4 size, A5 size, B4 size, B5 size, letter size, post card size and name card size.

28. An image forming apparatus according to claim 21, wherein said process cartridge includes developing means for developing a latent image formed on said image bearing member.

29. An image forming apparatus according to claim 21, wherein said process cartridge includes charger means for charging said image bearing member.

30. An image forming apparatus according to claim 21, wherein said convey means comprises a plurality of rollers spaced apart from each other in a widthwise direction of a convey path for the recording medium.

31. An image forming apparatus according to claim 21, wherein said convey means comprises a roller and a friction pad urged against said roller to separate recording media supplied from a supply cassette one by one.

32. An image forming apparatus according to claim 21, wherein said image forming apparatus comprises a laser beam printer.

33. An image forming apparatus according to claim 21, wherein said image forming apparatus comprises an LED printer.

34. An image forming apparatus according to claim 21, wherein said image forming apparatus comprises an electrophotographic copying device.

35. An image forming apparatus according to claim 21, wherein said image forming apparatus comprises a facsimile device.

36. An image forming system for forming an image on a recording medium, comprising:

an image bearing member having a rotational axis;

image forming means for forming an image on said image bearing member;

a cleaning mechanism for cleaning said image bearing member, said cleaning mechanism including receiving means, disposed along the rotational axis of said image bearing member said image bearing member, for receiving removed matter removed from said image bearing member and at least one partition member, disposed in a direction orthogonal to the rotational axis of said image bearing member, for partitioning said receiving member, each said partition member having a tip end opposing said image bearing member; and convey means for conveying the recording medium, said cleaning mechanism and said convey means being arranged so that the tip end of each said partition member of said cleaning mechanism opposing said image bearing member is aligned with a non-contacting area between the recording medium and said convey means located upstream of said image bearing member in a recording medium convey direction.

* * * * *

UNITED STATES PATENT AND TRADEMARK OFFICE

CERTIFICATE OF CORRECTION

PATENT NO. : 5,406,365

DATED : April 11, 1995

INVENTOR(S) : Mutsumi BABA, et al.

It is certified that error appears in the above-indentified patent and that said Letters Patent is hereby corrected as shown below:

COLUMN 2:

Line 52, "happy" should read --nappy--.
Line 57, "coagulated." should read --coagulated toner.--.

COLUMN 9:

Line 15, "3d," should read --3d, and--.
Line 40, "slipping" should read --spilling--.
Line 44, "3d," should read --3d and--.

COLUMN 12:

Line 22, "will generate." should read --will be generated.--.
Line 29, "be" should be deleted.

UNITED STATES PATENT AND TRADEMARK OFFICE

CERTIFICATE OF CORRECTION

PATENT NO. : 5,406,365 Page 2 of 2

DATED : April 11, 1995

INVENTOR(S) : Mutsumi BABA, et al.

It is certified that error appears in the above-indentified patent and that said Letters Patent is hereby corrected as shown below:

COLUMN 15:

Line 23, "claud" should read --cloud--.
Line 42, "incorporated" should read --incorporate--.

COLUMN 17:

Line 7, "of said" should read -- of each--.

COLUMN 20:

Line 21, "member said image bearing" should read --member,--.
Line 22, "member," should be deleted.

Signed and Sealed this

Eighteenth Day of July, 1995

Bruce Lehman

*Attest:*

BRUCE LEHMAN

*Attesting Officer*

*Commissioner of Patents and Trademarks*